US005612775A

United States Patent [19]

Nagaoka

[11] Patent Number: 5,612,775

[45] Date of Patent: Mar. 18, 1997

[54] DISPLACE CLEANING APPARATUS WITH TONER SCATTERING FEATURE AND ELECTROPHTOGRAPHIC IMAGE FORMING APPARATUS USING SAME

[75] Inventor: Tomoo Nagaoka, Tokyo, Japan

[73] Assignee: Canon Kabushiki Kaisha, Tokyo, Japan

[21] Appl. No.: 399,654

[22] Filed: Mar. 7, 1995

[30] Foreign Application Priority Data

Mar. 8, 1994 [JP] Japan ..... 6-036992
Mar. 2, 1995 [JP] Japan ..... 7-043004

[51] Int. Cl.[6] ..... G03G 21/00

[52] U.S. Cl. ..... 399/345; 399/353

[58] Field of Search ..... 355/296, 298, 355/301, 302, 304, 270, 297

[56] References Cited

U.S. PATENT DOCUMENTS

| | | | |
|---|---|---|---|
| 3,909,864 | 10/1975 | Tanaka et al. | 355/304 X |
| 3,969,785 | 7/1976 | Ogawa et al. | 355/302 X |
| 4,093,369 | 6/1978 | Hewitt | 355/296 |
| 4,264,190 | 4/1981 | Tsuda et al. | 355/302 |
| 4,295,734 | 10/1981 | Tsuda et al. | 355/304 |
| 4,841,330 | 6/1989 | Owada et al. | 355/245 |
| 4,984,028 | 1/1991 | Tonomoto | 355/297 |
| 5,107,304 | 4/1992 | Haneda et al. | 355/296 |
| 5,383,011 | 1/1995 | Numagami et al. | 355/298 |
| 5,406,364 | 4/1995 | Maeyama et al. | 355/296 |

*Primary Examiner*—Fred L. Braun
*Attorney, Agent, or Firm*—Fitzpatrick, Cella, Harper & Scinto

[57] ABSTRACT

A cleaning apparatus, which can be applied to an electrophotographic image forming apparatus, is adapted to remove toner adhered from a member to be cleaned. The apparatus includes a cleaning element for removing the adhered toner, a displaceable support for supporting the cleaning element, including a casing for containing the cleaning element therein, so that the cleaning element can be shifted between an operative position where the cleaning element contacts with the member to be cleaned and a retract position where the cleaning element is retracted from the operative position, and an elastic element for elastically biasing the cleaning element supported by the support toward the member to be cleaned. A toner scattering feature directs removed toner entrained by an airflow generated by movement of the cleaning element.

22 Claims, 7 Drawing Sheets

S : SLIDE STROKE

DISPLACE CLEANING APPARATUS WITH TONER SCATTERING FEATURE AND ELECTROPHTOGRAPHIC IMAGE FORMING APPARATUS USING SAME

BACKGROUND OF THE INVENTION

1. Field of the Invention

The present invention relates to a cleaning apparatus for removing matter adhered to a member to be cleaned, and an image forming apparatus having such a cleaning apparatus. The member to be cleaned may be a transfer drum or an electrophotographic photosensitive member, for example. Further, the electrophotographic image forming apparatus serves to form an image on a recording medium by using electrophotographic process and may be an electrophotographic copying machine, an electrophotographic printer, a word processor or a facsimile machine, for example.

2. Related Background Art

In electrophotographic image forming apparatuses such as copying machines, an electrophotographic photosensitive member uniformly charged by a charger is exposed in response to image information, thereby forming a latent image on the photosensitive member. The latent image formed on the photosensitive member is developed as a visible toner image. Then, the toner image formed on the photosensitive member is transferred onto a recording medium, thereby recording an image on the recording medium.

In such apparatuses, after the toner image was transferred, the residual toner remaining on the photosensitive member is removed by a cleaning apparatus. The cleaning apparatus may be of magnet brush type wherein the residual toner remaining on the photosensitive member is collected by a magnetic force of a magnet housed in a sleeve of blade type wherein the residual toner is scraped and collected by urging a rubber blade against the surface of the photosensitive member, or of fur brush type wherein the residual toner is collected by absorbing the toner on tip ends of fine fibers of a rotating brush with a friction-charged force.

The present invention relates to the improvement in the above-mentioned cleaning apparatus. Incidentally, in the above example, while the toner remaining on the photosensitive member was removed by the cleaning apparatus, the present invention can be applied to cleaning apparatuses for removing matters adhered to a transfer drum, for example.

SUMMARY OF THE INVENTION

An object of the present invention is to provide a cleaning apparatus and an image forming apparatus having such a cleaning apparatus, which can improve cleaning efficiency.

Another object of the present invention is to provide a cleaning apparatus and an electrophotographic image forming apparatus having such a cleaning apparatus, which can prevent the occurrence of cleaning unevenness.

A further object of the present invention is to provide a cleaning apparatus and an electrophotographic image forming apparatus having such a cleaning apparatus, which can be made compact.

A still further object of the present invention is to provide a cleaning apparatus and an electrophotographic image forming apparatus having such a cleaning apparatus, wherein the height of the apparatus is minimized, and compactness and less power consumption can be realized by omitting a suction fan and the like.

A further object of the present invention is to provide a cleaning apparatus and an electrophotographic image forming apparatus having such a cleaning apparatus, which can prevent cleaning unevenness by urging a rotary brush against a member to be cleaned with uniform urging pressure along a widthwise direction of the member to be cleaned.

The other object of the present invention is to provide a cleaning apparatus and an electrophotographic image forming apparatus having such a cleaning apparatus, which can completely remove toner even if density of residual toner is locally increased.

DETAILED DESCRIPTION OF THE PREFERRED EMBODIMENTS

The present invention will now be explained in connection with embodiments thereof with reference to the accompanying drawings.

First of all, an image forming apparatus to which an embodiment of the present invention is applied will be explained with reference to FIG. 6.

Figure 6:
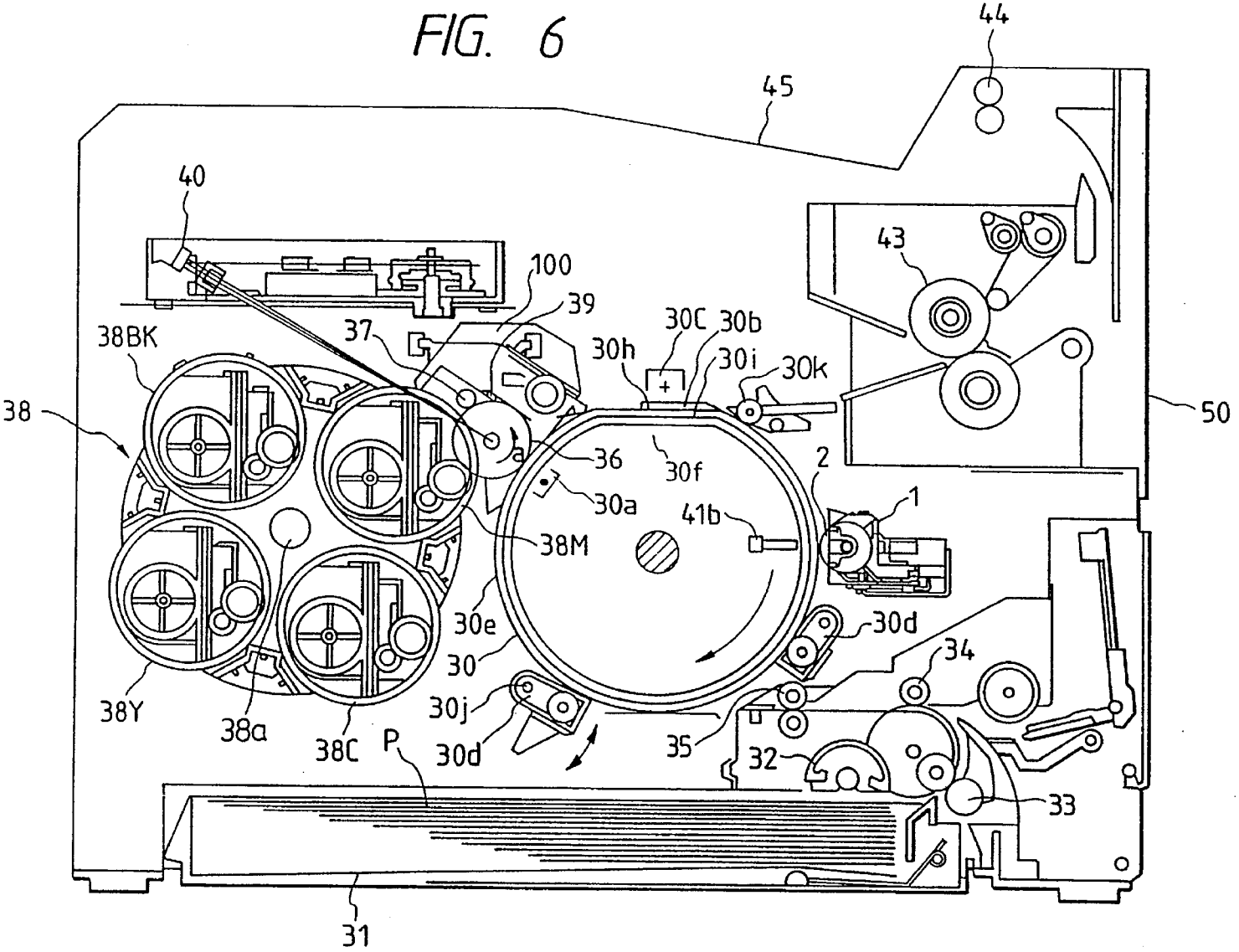
FIG. 6 is an elevational sectional view of an image forming apparatus to which the present invention is applied.

FIG. 6 shows an electrophotographic full-color image forming apparatus (full-color laser beam printer). In such a color image forming apparatus, a recording material (recording sheet, OHP sheet and the like) P is fed out by sheet supply rollers 32, 33 from a sheet supply cassette 31 removably mounted to a frame 50 of the image forming apparatus and then conveyed to a pair of register rollers 35 through a convey roller 34. Then, the recording sheet P is sent to a transfer drum 30 by means of the register rollers 35 in synchronous with a toner image for a first color formed on an electrophotographic photosensitive drum 36 and is absorbed to a peripheral surface of the transfer drum 30 for rotation together with it. Incidentally, in the illustrated embodiment, while the electrophotographic photosensitive drum was explained, in place of the drum, an electrophotographic photosensitive belt may be used.

The photosensitive drum 36 is rotated in a direction shown by the arrow a (FIG. 6) at a predetermined speed so that the surface of the drum 36 is uniformly charged by a charge means 37 such as a corona charger. A laser beam emitted from a scanner portion 4 in response to image information is illuminated onto the photosensitive drum 36, thereby forming a latent image corresponding to the image information on the photosensitive drum 36. The latent image for a first color is developed by magenta toner from a magenta developing device 38M of a developing means 38 to form a toner image. Then, the toner image (magenta color toner image) is transferred onto the recording sheet P held on the peripheral surface of the transfer drum 30 rotated at a peripheral speed the same as that of the photosensitive drum 36.

After the toner image was transferred to the recording sheet P, the residual toner remaining on the photosensitive drum 36 is removed by a cleaner (for example, an elastic cleaning blade) 39. At the same time, the developing means 38 including magenta, cyan, yellow and black developing devices 38M, 38C, 38Y and 38BK is rotated around a shaft 38D by 90 degrees, so that, in place of the magenta developing device 38M, the cyan developing device 38C is brought to a position opposed to the photosensitive drum 36. Incidentally, the magenta developing device 38M serves to develop the latent image by using magenta color toner. Similarly, the cyan developing device 38C, yellow developing device 38Y and black developing device 38BK serve to develop the latent image by using cyan color toner, yellow color toner and black color toner, respectively.

In a similar manner to the above, regarding the cyan color, the charging, and exposure, latent image formation and development are effected to form a cyan color toner image. Then, the cyan color toner image is transferred onto the same recording sheet P held on the peripheral surface of the transfer drum 30 in a superimposed fashion. Similarly, a yellow toner color image and a black toner color image are successively transferred onto the same recording sheet P in a superimposed fashion. The recording sheet P to which the four color toner images were transferred is separated from the transfer drum 30 by a separation means 30K, and the separated recording sheet is sent to a fixing device 43, where the toner images are fixed to the recording sheet P to form a full-color image. Thereafter, the recording sheet is discharged out of the apparatus. Incidentally, the residual toner remaining on the transfer drum 30 is removed and collected by a cleaning apparatus 1 according to the present invention. In FIG. 6, the reference numeral 44 denotes a pair of discharge rollers for discharging the recording sheet P; and 45 denotes a sheet receiving means provided on the frame and adapted to receive the discharged recording sheet P.

A transfer charger 30*a* serves to transfer the toner image formed on the photosensitive drum 36 onto the recording sheet P held on the peripheral surface of the transfer drum 30. Grippers 30*b* serve to grip a tip end of the recording sheet P in order to wind the recording sheet P around the peripheral surface of the transfer drum 30. The grippers 30*b* are pivotally mounted on corresponding shafts 30*j* for rotation in a direction shown by the arrow. Further, the grippers 30*b* are provided on flat portions 30*i* of the transfer drum 30 as will be described later. A separation charger 30*c* serves to facilitate the separation of the recording sheet P from the peripheral surface of the transfer drum 30. The reference numeral 30*d* denotes a small convey roller. A dielectric sheet 30*e* serves to electrostatically absorb the recording sheet P to wind the recording sheet around the peripheral surface of the transfer drum 30.

Incidentally, in FIG. 6, although the gripper 30*b* is shown in an enlarged scale for facilitating the understanding of the gripper, in practice, the gripper is provided on the flat portion 30*i* of the transfer drum 30 in such a manner that, even when the flat portion 30*i* is opposed to the photosensitive drum 36, the gripper 30*b* does not contact with the photosensitive drum 36.

As mentioned above, in the color image forming apparatus, the transfer drum 30 is provided with the bearing sheet, i.e. dielectric sheet 30*e* for bearing the recording sheet P. Further, in the proximity of the peripheral surface of the transfer drum 30, there are disposed the photosensitive drum 36, the developing means 38 and the cleaner 39 for adhering, shifting, storing and collecting the toner as a unit. In this case, there is a danger of smudging the bearing sheet 30*e* on the transfer drum 30 with the undesirable toner scattered from the unit.

Accordingly, a cleaning means 41 is provided for removing the toner adhered to the bearing sheet 30*e* of the transfer drum 30. The cleaning of the transfer drum 30 and accordingly the bearing sheet 30*e* is normally effected during pre-rotation of the transfer drum 30 effected prior to the transferring of the toner image. Further, the cleaning is always effected after a sheet jam treatment was performed, because there is a danger of adhering the toner to the bearing sheet 30*e* when the sheet jam occurs.

In the illustrated embodiment, the cleaning means 41 for the bearing sheet 30*e* comprises a rotary brush 1 disposed outside of the bearing sheet 30*e* of the transfer drum 30, and a back up brush 41*b* disposed inside of the transfer drum in a confronting relation to the rotary brush.

Further, in the illustrated embodiment, in order to adjust the density of the image, a toner image 20 (FIGS. 1 and 5) as a local density detecting toner patch is formed on a central portion of the photosensitive drum 36 in an axial direction thereof during pre-rotation of the drum prior to the image formation. The toner patch is directly transferred onto the transfer drum 30 and the density of the transferred image is detected by a density detecting means to adjust the density. In this case, since the toner having high density is locally adhered to the transfer drum 30, the cleaning means 41 must be particularly devised. As will be described later, according to the embodiment shown in FIGS. 1 and 5, such high density toner can also be removed completely.

Figure 1:
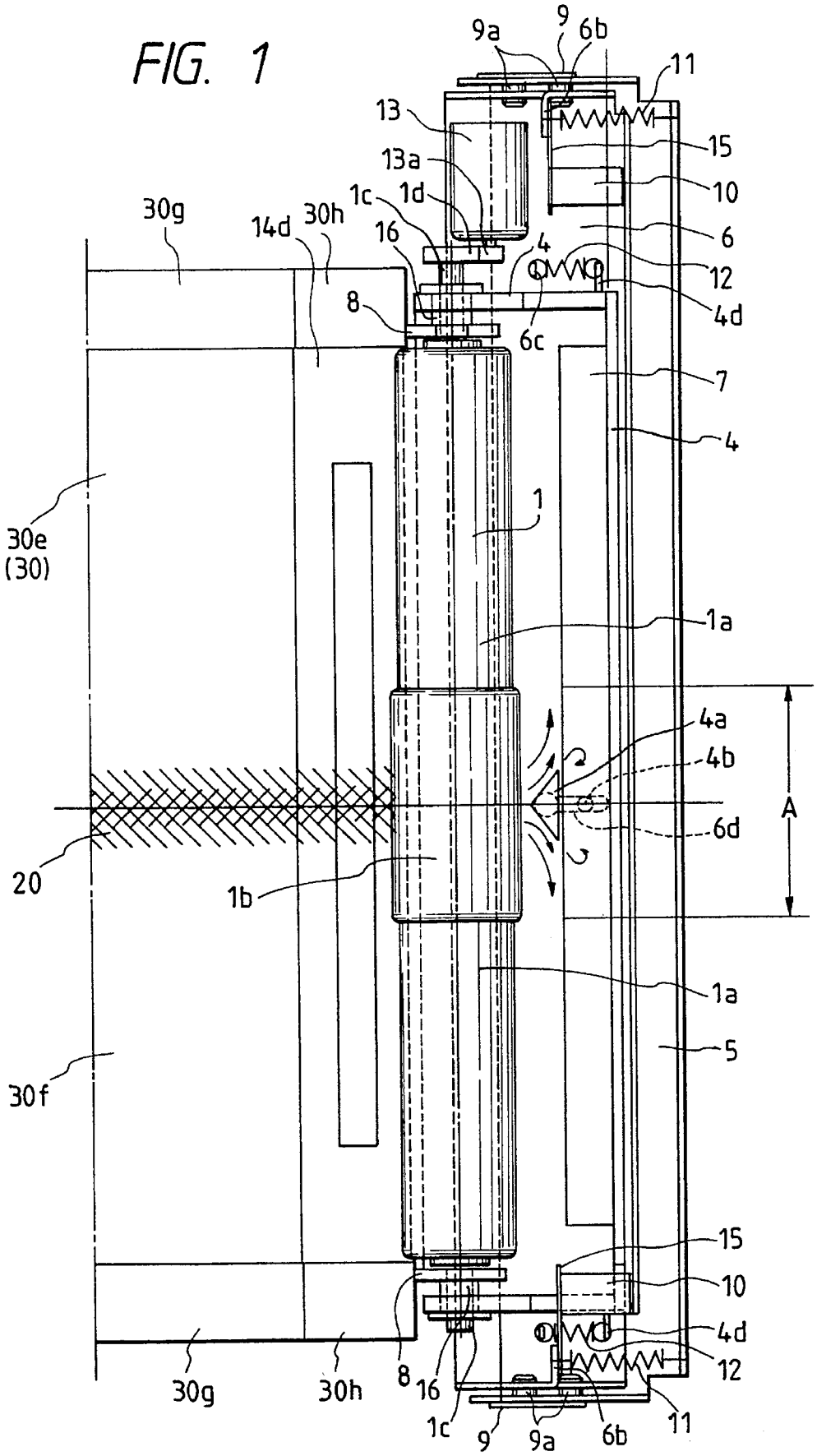
FIG. 1 is a plan view showing a first embodiment of the present invention.
Figure 2:
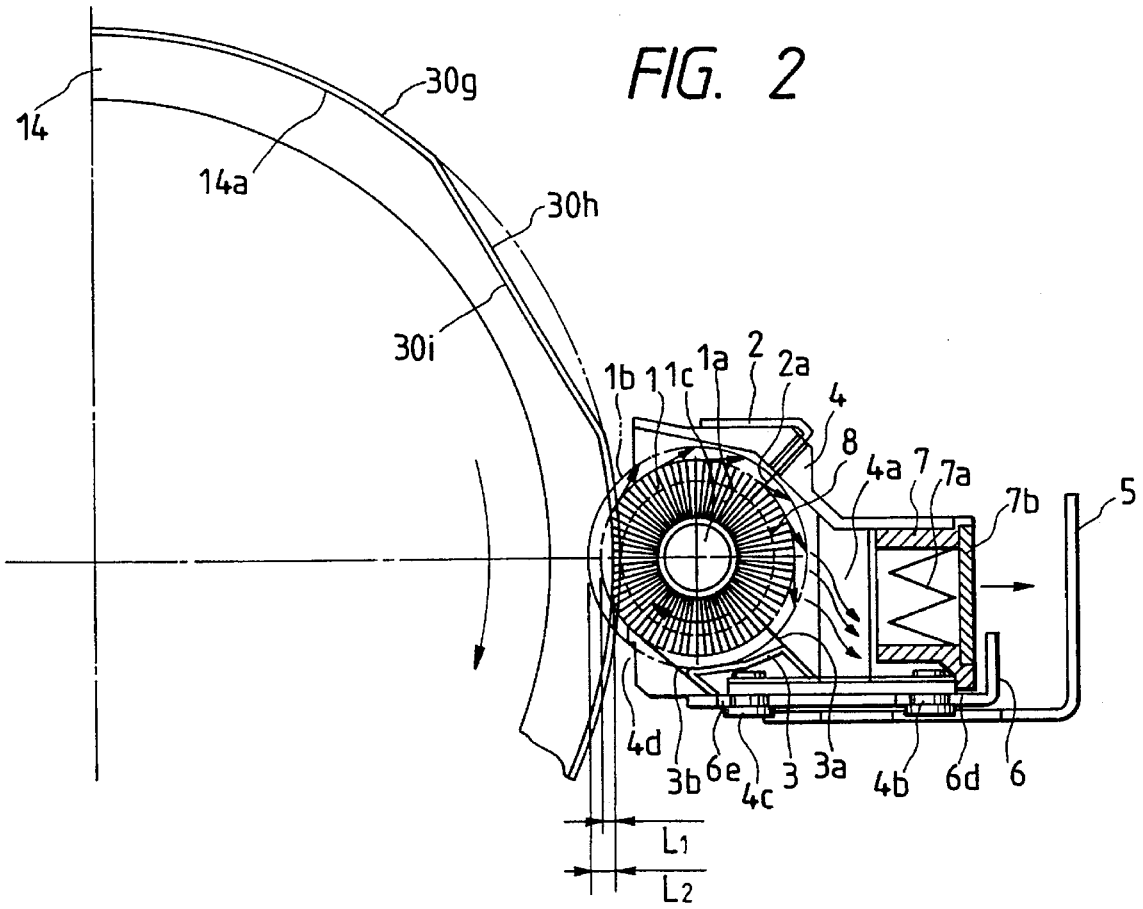
FIG. 2 is a cross sectional view of a cleaning apparatus of FIG. 1.
Figure 3:
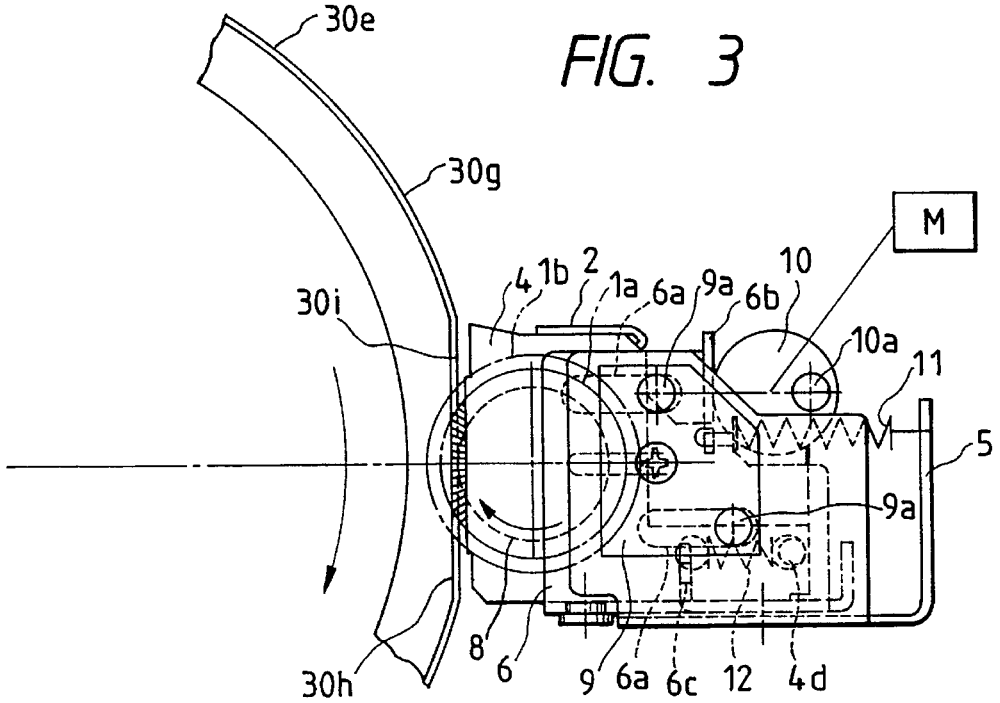
FIG. 3 is a left side view of the cleaning apparatus of FIG. 1.

FIG. 1 shows an embodiment wherein a member to be cleaned is the transfer drum 30. FIG. 1 is a plan view of the transfer drum 30 looked at from a tangential direction of the drum. However, a brush case 4 is shown as a sectional view. FIG. 2 is a cross-sectional view of elements of FIG. 1, and FIG. 3 is a side view of the elements of FIG. 1. In FIGS. 1 to 3, the member to be cleaned is the dielectric bearing sheet 30*e* mounted around an aluminum frame 30*f* constituted by both end ring members interconnected by an axial connecting member. The aluminum frame 30*f* is provided at its both longitudinal ends with roller guide surfaces 30*g*. Each guide surface 30*g* has a flat portion 30*h* constituted by a cord surface connecting between adjacent cylindrical surfaces. As mentioned above, the grippers 30*b* are provided on the flat surfaces 30*h*.

A brush shaft 1*c* on which the rotary brush 1 acting as a rotary cleaning member is mounted is rotatably supported by bearings 16 secured to the brush case 4. Abutment guide rollers 8 are secured to the brush shaft 1*c* in the proximity of the respective bearings 16. The abutment guide rollers 8 are urged against the respective roller guide surfaces 30*g* or the flat surfaces 30*h*. A mechanism for urging the abutment guide roller 8 against the roller guide surface 30*g* or the flat surface 30*h* will be described later. A gear 1*d* secured to the brush shaft 1*c* of the rotary brush 1 is meshed with a gear 13*a* secured to a motor shaft of a motor 13 secured to the brush case 4.

Figure 4:
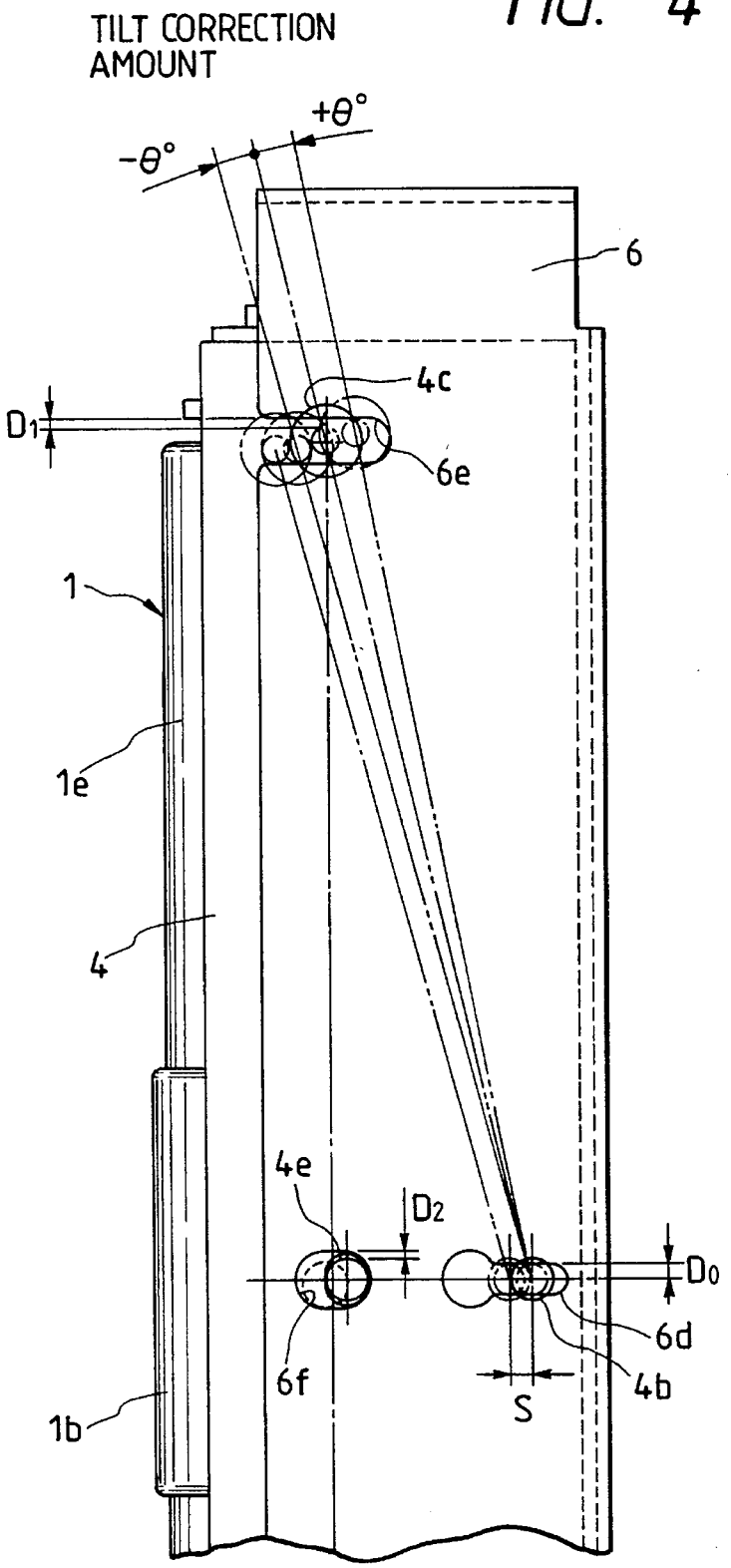
FIG. 4 is a bottom view of the cleaning apparatus of FIG. 1.

As shown in FIGS. 2 and 4, slide support shafts 4*b*, 4*c* are fitted into bottom surface slide slots 6*d*, 6*e* formed in a slide plate 6 (extending in a front-and-rear direction toward the bearing sheet 30*e* (transfer drum 30) for shifting movement in the front-and-rear direction. At both sides of the brush case 4, springs 12 are disposed between hooks 4*d* formed on the brush case 4 and hooks 6*c* formed on the slide plate 6 so that the rotary brush 1 can be urged against the bearing sheet 30*e* (transer drum 30) via the brush case 4, bearings 16 and brush shaft 1*c*.

FIG. 4 shows a positional relation between the slide support shafts 4*b*, 4*c* and the slots 6*d*, 6*e*. One bottom surface slide slot 6*d* is disposed at a rear portion of a central zone of the slide plate 6 in the axial direction of the brush shaft 1*c*, two left and right bottom surface slots 6*e* are disposed at front portions of end zones of the slide plate (only one of slots 6*e* is shown in FIG. 4). The slots 6*d* and 6*e* extend perpendicular to the axis of the transfer drum 30. A distance $D_0$ between the slot 6*d* and the slide support shaft 4*b* at one side is smaller than a distance $D_1$ between each slot 6*e* and the slide support shaft 4*c* at one side ($D_0<D_1$), and the distance $D_0$ is minimized as small as possible so that the slide support shaft 4*b* can be shifted straightly. The brush case 4 can be rocked around the slide support shaft 4*b* in the plane of FIG. 4 toward and away from the bearing sheet 30*e* (transfer drum 30).

In this way, the brush case 4 is floatingly supported in such a manner that the rotary brush can abut against the transfer drum 30 with uniform pressure through the axial length of the drum. A brush case stopper 4*e* formed on the brush case 4 is fitted into a brush case stopper hole 6*f* formed in the slide plate 6 for shifting movement in the front-and-rear direction so that the brush case 4 does not depart in the front-and-rear direction. Further, there are clearances $D_2$between the brush case stopper 4*e* and the brush case stopper hole 6*f* at both sides respectively, to permit the tilting movement of the brush case 4 around the slide support shaft 4*b*. Incidentally, the clearance $D_2$ is greater than the distance $D_0$ ($D_2>D_0$).

As shown in FIG. 3, side slide slots 6*a* extending in the front-and-rear direction (regarding the transfer drum 30) are formed in side walls of the slide plate 6. Slide shafts 9*a* secured to a fixed bottom plate 5 are fitted into the corresponding slot 6*a*. Two upper and lower slide shafts 9*a* are welded to slide holder plates 9 which are secured to side walls of the bottom plate 5.

Push plate slide return springs 11 are under tension between the rear side plate of the bottom plate 5 and spring attachment portions 6*b* provided on the slide plate 6 to bias the slide plate 6 away from the transfer drum 30. Urging cams 10 rotatably supported via their eccentric shafts 10*a* by bearings (not shown) provided on the bottom plate 5 are urged against cantilever push plate springs 15 (bases of which are secured to the respective spring attachment portions 6*b*) from a direction to advance the slide plate 6 in opposition to the spring forces of the slide return springs 11. The urging cam 10 is connected to a drive source M so that the cam can assume a maximum cam lift position as shown in FIGS. 1 to 3, and a minimum cam lift (cam lift zero) position obtained when the eccentric shaft 10*a* is rotated by 90 degrees from the position of FIG. 3.

Regarding the polluted high density toner portion 20 on the bearing sheet 30*e* (transfer drum 30), the rotary brush 1 has local brush fibers 1*b*, each having greater diameter and greater length than that of each of brush fibers 1*a* for cleaning the whole width of the transfer drum 30.

The brush case 4 is opened toward the transfer drum 30 along the whole length of the rotary brush 1 for covering the width of the bearing sheet 30*e* (transfer drum 30) to be cleaned. As shown in FIG. 2, the opening 4*d* of the brush case 4 is opened toward the transfer drum 30 in the front-and-rear direction. Within the brush case, there is disposed a rotary brush 1 at a front portion thereof, and a folded filter 7*a* provided in a filter housing 7 at a rear portion thereof. Further, an end filter 7*b* for collecting fine powder is disposed at a rear side of the filter 7*a*, and a toner reservoir for storing the toner collected by the rotary brush 1 is positioned at a rear side of the rotary brush. Scraper blade 2*a* and 3*a* attached to the brush case 4 via respective scraper holders 2 and 3 are disposed to contact with the peripheral surface of the rotary brush 1 along the rotational direction of the rotary brush, these blades facing the toner reservoir. Tip ends of the scraper blades 2*a* and 3*a* are radially penetrated into the rotary brush 1. Incidentally, the rotary brush 1 is rotated in a clockwise direction in FIGS. 2 and 3. A blow preventing seal plate 3*b* having a tip end contacted with the peripheral surface of the rotary brush 1 along the rotational direction of the latter is attached to the scraper holder 3, thereby defining a closed space.

As shown in FIG. 1, a toner scattering member 4*a* tapered toward the central zone (in the axial direction) of the rotary brush 1 is uprightly formed within the brush case 4. The toner scattering member 4 connects between a top plate and the bottom plate of the brush case 4 and serves to reinforce the brush case having a wide inner space, thereby preventing the deformation of the brush case 4 to stabilize the position of the brush shaft 1*a* of the rotary brush 1.

Next, an operation of the illustrated embodiment will be explained.

In the condition shown in FIGS. 1 to 3, the urging cams 10 assume their maximum lift positions to bring the slide plate 6 to the foremost limit position via the push plate springs 15 in opposition to the biasing forces of the slide return springs 11, and the springs 12 are extended. The brush case 4 is biased toward the advancing direction by the brush urging springs 12 so that the brush portion 1*a* of the rotary brush 1 for cleaning the whole width of the transfer drum 30 is urged against the bearing sheet (transfer drum 30) to be flexed by a penetrated amount of $L_1$ as shown in FIG. 2. Further, the local brush portion 1*b* is flexed by a penetrated amount of $L_2$. In this condition, as shown in FIG. 4, the slide support shafts 4*b*, 4*c*, and the brush case stopper 4*e* are positioned as shown by the broken lines. The rotary brush 1 is uniformly urged against the bearing sheet 30*e* (transfer drum 30) by tilting around the slide support shaft 4*b* within a tilt range of $\pm\theta$ in FIG. 4.

When the rotary brush is urged against the bearing sheet 30*e* (transfer drum 30) in this way, the transfer drum 30 is rotated by a rotating means (not shown) and the rotary brush 1 is rotated in the same direction by transmitting the rotational force of the motor 13 to the brush through the gears 13*a* and 1*d*. At a contact zone between the bearing sheet 30*e* (transfer drum 30) and the rotary brush 1, the peripheral surface of the transfer drum is shifted in a direction opposite to a direction that the peripheral surface of the rotary brush is shifted, so that the toner on the bearing sheet 30*e* is adhered to the rotary brush 1. By air flow generated by the pump action of the rotating rotary brush 1 due to the contact between the blow preventing seal plate 3*b* and the brush to close the clearance between the brush 1 and the brush case 4, the collected toner is shifted outwardly from the peripheral surface of the rotary brush 1 as shown by the plural arrows to be collected into the brush case 4. In this case, the toner adhered to the main brush portion 1*a* and the local brush portion 1*b* is scattered into the airflow by the action of the scraper blades 2*a* and 3*a* contacting with the brush and the elastic restoring action of the brush fibers, and is entrained with the airflow. The air flow from which the toner particles were removed by the folded filter 7*a* and the end filter 7*b* is discharged out of the brush case 4.

At the central zone of the rotary brush 1, since the high density toner is removed by the local brush portion 1*b* strongly urged against the polluted high density toner portion 20 on the bearing sheet 30*e*, the air containing a larger amount of toner tries to flow locally through a central zone (in the axial direction) of the folded filter 7*a*. However, since the air containing the larger amount of toner is scattered toward the longitudinal direction of the folded filter 7*a* by the toner scattering member 4*a*, the toner collecting area is increased, thereby preventing the folded filter 7*a* from being clogged with the toner locally. Accordingly, it is possible to prevent a premature exchange of the filter due to local toner clogging. Incidentally, as mentioned above, the high density toner portion 20 is formed by transferring the toner band formed on the photosensitive drum 36 for adjusting the image density onto the bearing sheet 30*e* directly.

Further, as mentioned above, the brush case 4 is tilted around the slide support shaft 4*b* within the range of tilt correcting amount of ±θ as shown in FIG. 4 so as to ensure an abutment between the rotary brush 1 and the transfer drum 30 with a uniform urging pressure along the axial direction of the transfer drum 30, and the slide support shafts 4*c* are shifted in the bottom surface slide slots 6*e* formed in the slide plate 6. Accordingly, the rotary brush 1 is urged against the transfer drum 30 with a uniform urging pressure along the axial direction of the transfer drum 30.

Before the recording sheet P is held on the transfer drum 30, the urging cams 10 are rotated by 180 degrees to reach their cam lift zero positions. As a result, the slide plate 6 is retarded or retracted by the biasing forces of the slide return springs 11, and the push plate springs 15 follows the urging cams 10. Consequently, since the spring attachment portions 6*c* are also retarded, the springs 12 are contracted, with the result that the slide plate 6 is retarded together with the slide support shaft 4*b* by a slide stroke S. The springs 12 are further contracted to retard the brush case 4, thereby separating the rotary brush from the bearing sheet 30*e* (transfer drum 30) which is the member to be cleaned.

In the illustrated embodiment, while an example that the rotary brush 1 has the main brush portion 1*a* having the penetrated amount of $L_1$ with respect to the bearing sheet 30*e* (transfer drum 30) and the local brush portion 1*b* having the penetrated amount of $L_2$ was explained, the brush portions 1*a* and 1*b* may be formed integrally or assembled independently. Further, the brush portions 1*a* and 1*b* may be made of different materials, or may have different shapes from the above, or may be combined with other cleaning members (such as sponge members). However, in the illustrated embodiment, the brush portions 1*a* and 1*b* were made of the same material, and the diameter and length of each of the brush fibers 1*a* were differentiated from those of the brush fiber 1*b*.

Now, a slide mechanism of the cleaning apparatus in which the present invention is applied will be fully explained with reference to FIGS. 2 and 3.

The cleaning apparatus according to the illustrated embodiment is of fur brush type wherein the rotary brush 1 is rotated. The rotary brush 1 is constituted by providing a great number of brush fibers on a surface of a roller having an axial length substantially the same as that of the transfer drum 30 and is mounted on the brush shaft 1*c* rotatably supported by the brush case 4. The rotary brush 1 can be rotated in the clockwise direction by the motor 13 attached to the brush case 4. The guide rollers 8 each having a radius smaller than that of the rotary brush by a value L are rotatably mounted on both longitudinal end portions of the brush shaft 1*c*. As will be described later, the guide rollers 8 serve to abut against the guide surfaces of the transfer drum 30 during the cleaning operation, thereby positioning the rotary brush 1 and the transfer drum 30.

The brush case 4 supporting the rotary brush 1 has the inlet opening and the outlet opening. The rotary brush 1 is mounted within the brush case in such a manner that the rotary brush 1 is partially protruded from the inlet opening, and the filter housing 7 is attached to the outlet opening. The filter housing 7 includes the folded filter 7*a* and the end filter 7*b* for collecting the toner removed from the bearing sheet 30*e* and is removably mounted to the brush case 4.

The brush case 4 is mounted on the slide plate 6 for sliding movement in a left-and-right direction in FIG. 2 with respect to the slide plate. The tension springs 12 are disposed between the spring attachment portions 4*d* of the brush case 4 and the spring attachment portions 6*c* of the slide plate 6, thereby biasing the brush case 4 toward the transfer drum 30 (left in FIG. 2) with respect to the slide plate 6. The first scraper blade 2*a* and the second scraper blade 3*a* are disposed within the brush case 4 at predetermined positions to be contacted with the rotary brush 1 so that the closed space is defined by the blades 2*a*, 3*a*, rotary brush 1 and filter housing 7. Incidentally, the blades 2*a* and 3*a* are provided with vent holes.

The slide plate 6 is provided with side walls having side slots 6*a* into which the shaft 9*a* of the bottom plate 5 secured to the frame of the image forming apparatus are fitted. Thus, the slide plate 6 can be slid with respect to the bottom plate 5 within a predetermined range defined by the side slots 6*a* so that the slide plate 6 can be slid together with the brush case 4. The slide plate 6 further has the attachment portions 6*b* urged by the cams, and the tension springs 11 are disposed between the slide plate 6 and the bottom plate 5 so that the attachment portions 6*b* are urged against the eccentric cams 10 of the image forming apparatus via the springs 15.

Next, the operation of the cleaning apparatus will be explained. When the transfer drum 30 is rotated to perform the image formation, the eccentric cams 10 and the cleaning apparatus are rotated to urge the slide plate 6 toward the transfer drum 30, with the result that the slide plate is slid together with the brush case 4 toward the transfer drum 30. When the guide rollers 8 abut against the guide surfaces of the transfer drum 30, the brush case 4 cannot be slide even when the slide plate 6 is further shifted toward the transfer drum 30, and the guide rollers 8 are urged against the transfer drum by the biasing forces of the tension springs 12. In this way, the surface of the bearing sheet 30*e* (transfer drum 30) and the rotary brush 1 are positioned so that the rotary brush 1 can be rotated while contacting with the surface of the bearing sheet 30*e*. Incidentally, in this case, the guide rollers 8 are driven by the rotation of the transfer drum 30.

When the rotary brush 1 is rotated, the residual toner remaining on the bearing sheet 30*e* is adhered to the tip ends of the brush fibers of the brush 1 by the friction charged force and is scraped out by the brush 1. The toner is entrained by the air flow (shown by the arrows tangential to the peripheral surface of the brush 1 in FIG. 2) generated by the rotation of the rotating brush 1 and enters into the brush case 4. Further, the toner adhered to the rotary brush 1 is separated from the brush 1 by the scraper blades 2*a* and 3*a*, the separated toner being conveyed by the air flow into the filter housing and is collected by the filters 7*a* and 7*b*. In this way, the residual toner remaining on the bearing sheet 30*e* is removed.

On the other hand, when the image formation is finished, the eccentric cams 10 are rotated by 180 degrees, the slide plate 6 is pulled away from the photosensitive drum 36 by the tension springs 11 (right in FIG. 2). As a result, the brush case 4 is slid together with the slide plate 6, thereby returning the rotary brush 1 to the waiting position spaced apart from the photosensitive drum 36.

Incidentally, the sliding amount of the brush case 4 on the slide plate 6 biased by the tension springs 12 is greater than a depth of the flat portion 30*i* of the transfer drum 30 to be cleaned so that the surface of the bearing sheet 30*e* including the sheet portion belonging to the flat portion 30*i* can be cleaned. This is ensured by the fact that the above-mentioned sliding amount of the brush case 4 is sufficient and the fact that the guide rollers 8 are surely rolled on the guide surfaces 30*g* and the flat guide surface 30*h* by the spring forces of the tension springs 12.

Further, it is not necessary that both of the scraper blades 2*a* and 3*a* are contacted with the rotary brush 1, but only one of the scraper blades may be contacted with the rotary brush 1 and the other scraper blade may be spaced apart from the brush 1 to act as a suction guide.

As mentioned above, by designing the rotary brush 1 as a slidable mechanism, a wide space above the cleaning apparatus is not required, thereby making the apparatus compact. Further, since the toner can be conveyed through the filters 7*a*, 7*b* by the airflow generated by the rotation of the rotary brush 1, an additional discharge fan and the like can be omitted. However, if necessary, such an additional fan may be provided.

Next, another embodiment of a cleaning apparatus will be explained with reference to FIG. 7. Incidentally, the same elements as those in the above-mentioned embodiment are designated by the same reference numerals and explanation thereof will be omitted.

A cleaning apparatus according to this embodiment also has the rotary brush 1, brush case 4, slide plate 5 and bottom plate 5, and a mechanism for sliding the transfer drum 30 toward the rotary brush 1 is the same as that in the above-mentioned embodiment. The cleaning apparatus according to this embodiment differs, in toner conveying and storing method, from that of the above-mentioned embodiment.

Figure 7:
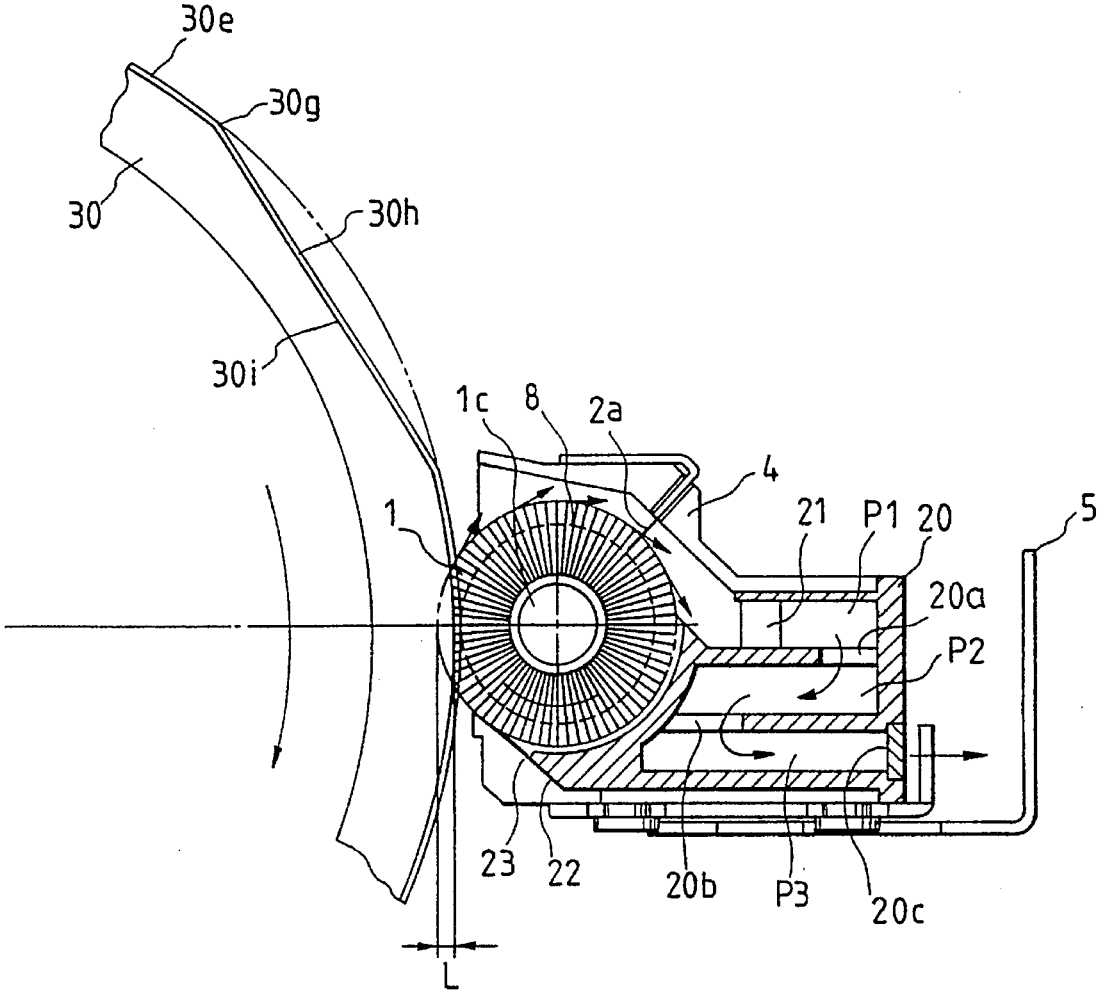
FIG. 7 is a cross-sectional view of a cleaning apparatus according to another embodiment of the present invention.

That is to say, as shown in FIG. 7, in the cleaning apparatus according to this embodiment, a replaceable filter housing 20 is divided into three chambers P1, P2, P3 along a vertical direction, and these chambers are communicated with each other through communication passages 20*a*, 20*b*. Accordingly, the toner separated from the rotary brush 1 by the scraper blade 2*a* is directed to the first chamber P1 along a suction guide plate 21 and the inner wall of the brush case 4 by the airflow generated by the rotation of the rotary brush 1, and then is directed to the second or intermediate chamber P2 through the communication passage 21*a*, and then is directed to the third chamber P3 through the communication passage 20*b* to reach an end filter 20*c*. The toner is caught by the end filter 20*c*. In this case, when the toner is being conveyed through the chambers P1 to P3, a large amount of toner is accumulated and stored in the respective chambers due to the reduction in speed and pressure of the airflow. Accordingly, it is possible to prevent the toner from leaking out of the housing 20.

Incidentally, in this embodiment, a guide surface 22 opposed to the rotary brush 1 is arcuate to accommodate the peripheral surface of the rotary brush 1, thereby preventing occurrence of the toner blowing pressure, and a seal plate 23 is provided on a top end of the guide surface 22.

Figure 5:
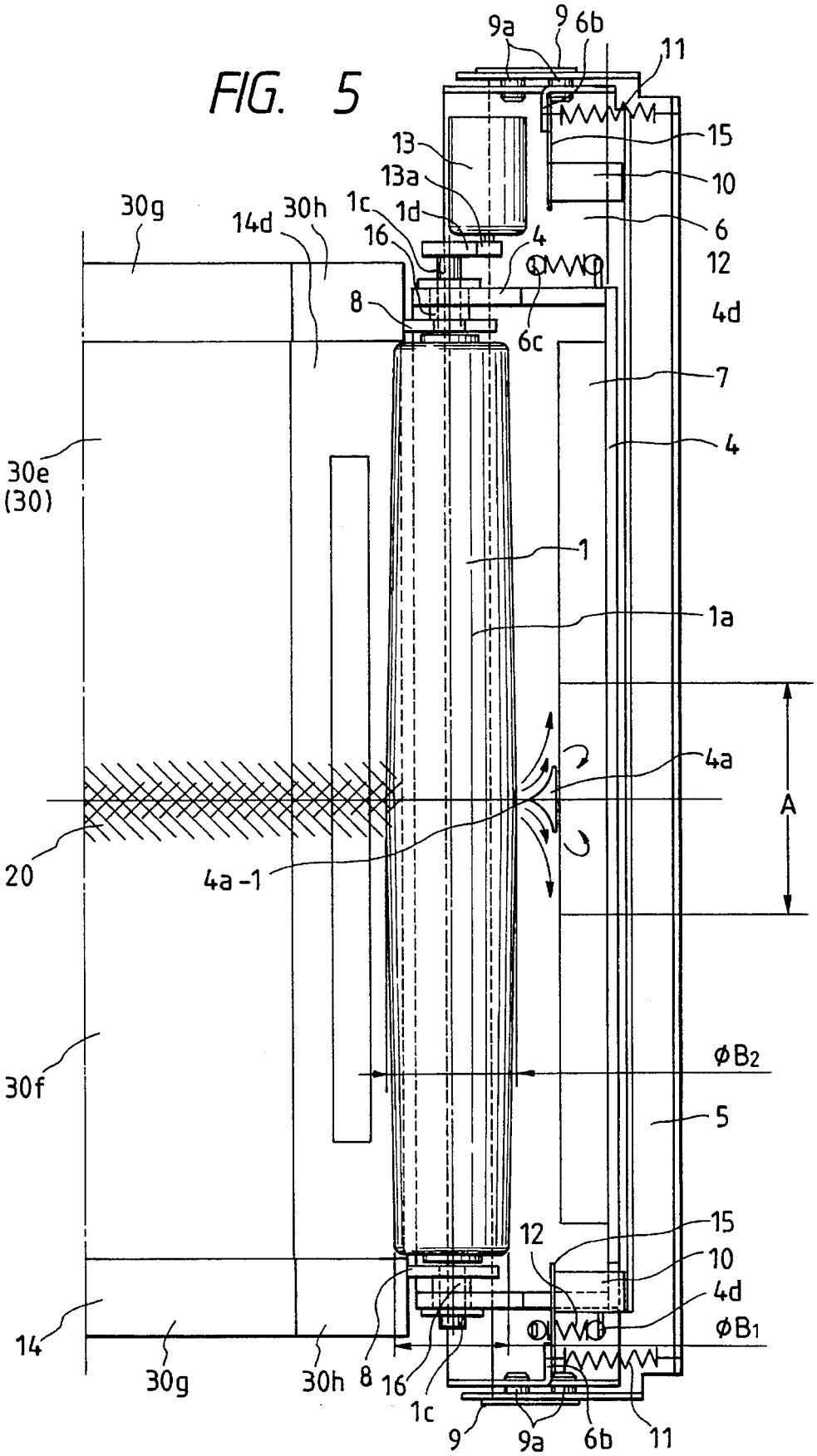
FIG. 5 is a plan view showing a second embodiment of the present invention.

A further embodiment will be explained with reference to FIG. 5.

This embodiment is the same as the embodiment shown in FIG. 1 except for the rotary brush 1 and the toner scattering member 4*a*, and, thus, explanation of the elements same as those of the embodiment in FIG. 1 will be omitted. A rotary brush 1 has a barrel shape (i.e. has a crown) so that a central zone (in an axial direction) of the rotary brush having a maximum diameter (ϕB2) is aligned with the high density polluted portion (density detecting toner patch) 20 on the bearing sheet. The maximum diameter (ϕB2) portion of the rotary brush has a penetrating amount of $L_2$ and a minimum diameter (ϕB1) portion has a penetrated amount of $L_1$, and, by increasing the diameter of the rotary brush from the minimum diameter ϕB1 to the maximum diameter ϕB2 as a function of an appropriate parameter, it is possible to eliminate poor cleaning, local stress concentration, fatigue and creep.

In this embodiment, a toner scattering member 4*a* has a surface for separating the airflow sent from the rotary brush 1 into left and right side flow components, which surface includes curved surface portions. That is to say, in order to scatter the toner into the wider area, the tangential angle (derivative value) of each curved surface portion is gradually changed from an apex $4_{a-1}$ to deflect the airflow entraining the toner by about 90 degrees so that a toner collecting range A is increased in comparison with that in the embodiment of FIG. 1, thereby increasing the toner scattering ability.

Figure 8:
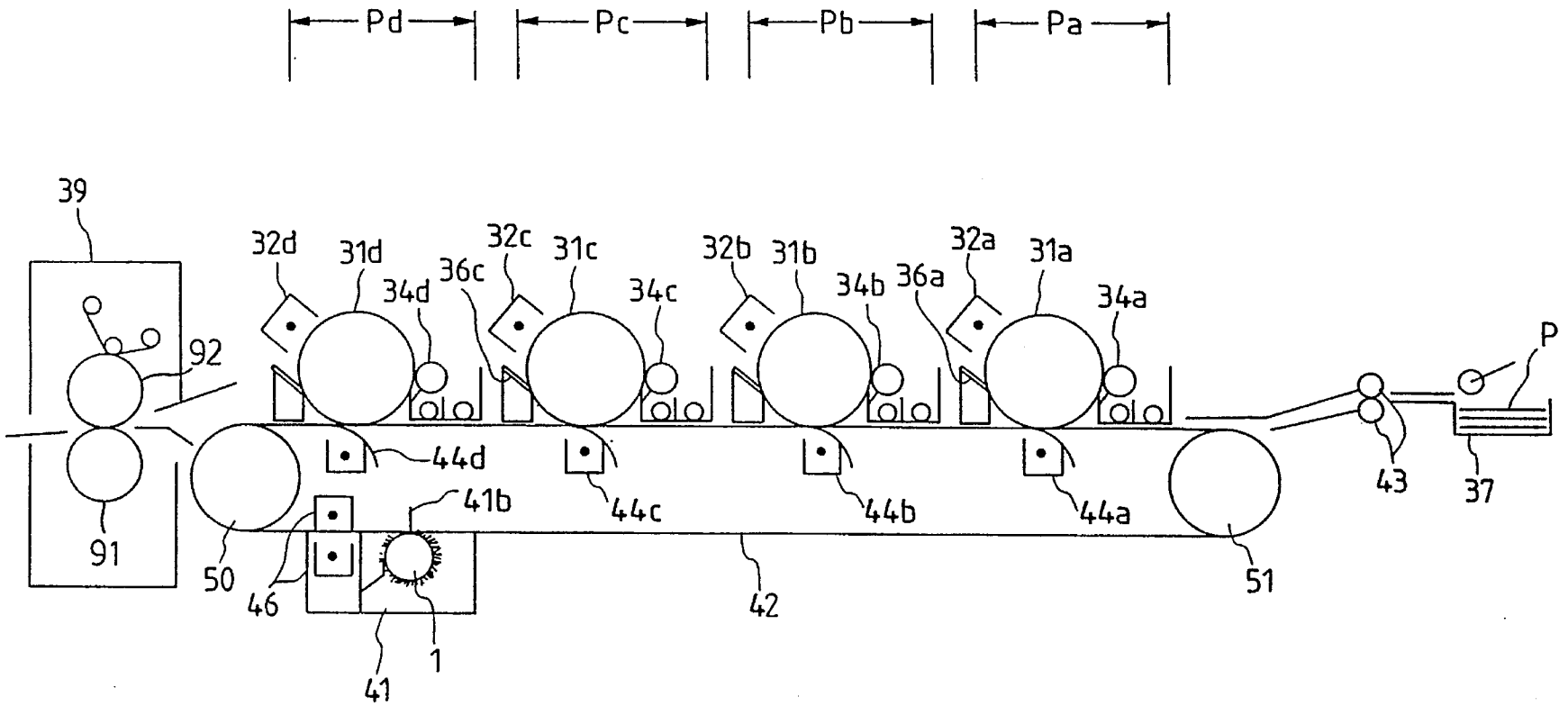
FIG. 8 is a schematic sectional view of an image forming apparatus to which an embodiment of the present invention is applied.

In the above-mentioned embodiments, while the member to be cleaned was the transfer drum, the member to be cleaned may be the photosensitive drum and the like, for example. Further, in a color electrophotographic recording apparatus as shown in FIG. 8, the present invention can be applied to clean a transfer belt 42 or photosensitive drums 31*a*, 31*b*, 31*c* and 31*d*. Briefly explaining FIG. 8, the color electrophotographic recording apparatus includes therein first, second, third and fourth image forming portions Pa, Pb, Pc, and Pd arranged side by side to form different color toner images by latent image formation, development and transfer processes.

The image forming portions Pa, Pb, PC, and Pd have electrophotographic photosensitive drums 31*a*, 31*b*, 31*c*, and 31*d*, respectively, and images formed on the photosensitive drums 31*a*, 31*b*, 31*c*, and 31*d* in the image forming portions Pa, Pb, Pc, and Pd are successively transferred onto a recording sheet P held and conveyed by a transfer belt 42 moved along the image forming portions. Then, the recording sheet P is sent to a fixing device 39, where the color toner images are fixed to the recording sheet with heat and pressure to form a full-color image. Thereafter, the recording sheet P is discharged out of the apparatus.

Around the photosensitive drums 31*a*, 31*b*, and 31*d*, there are disposed exposure lamps (not shown), corona chargers 32*a*, 32*b*, 32*c*, and 32*d*, light sources (not shown), polygon mirrors (not shown) for scanning the light beams emitted from the light sources, and potential sensors, respectively. By illuminating the laser beams emitted from the light sources (not shown) onto the rotating polygon mirrors, reflection mirrors and Fθ lenses (for focusing the reflected laser beams onto the photosensitive drums 31*a*, 31*b*, 31*c*, and 31*d*) onto the respective photosensitive drums 31*a* to 31*d* latent images corresponding to image color signals are formed on the respective photosensitive drums.

Developing devices 34*a*, 34*b*, 34*c*, and 34*d* are filled with cyan (C) color toner, magenta (M) color toner, yellow (Y) color toner and black (BK) color toner supplied from toner supply devices (not shown), respectively. The latent images formed on the photosensitive drums 31*a*, 31*b*, 31*c*, and 31*d* are developed by the toners from the developing devices 34*a*, 34*b*, 34*c*, and 34*d* to form different color toner images, respectively.

The recording sheet P is sent from a recording sheet supply cassette 37 to the transfer belt (recording sheet bearing member) 42 through a pair of regist rollers 43. The transfer belt 42 extends between and is wound around a drive roller 50 and a driven roller 51. An upper run of the transfer belt is contacted with the photosensitive drums 31*a* to 31*d*.

When the transfer belt 42 is rotated and a predetermined position of the transfer belt is detected, the recording sheet P is conveyed onto the transfer belt 42 from the regist rollers 43. In this case, an image write start signal is turned ON so that the image formation regarding the photosensitive drum 31*a* is started. By applying an electrical field or charge to a transfer charger 44*a* disposed below the photosensitive drum 31*a*, the toner image formed on the photosensitive drum 31*a* is transferred onto the recording sheet P. In this case, the recording sheet P held on the transfer belt 42 by an electrostatic absorbing force is sent to the second image forming portion Pb. Then, similarly, the toner images formed on the photosensitive drums 31*b*, 31*c* and 31*d* in the second, third and fourth image forming portions Pb, Pc and Pd are successively transferred onto the same recording sheet P in a superimposed fashion by transfer chargers 44*b*, 44*c*, and 44*d*. Thereafter, the recording sheet P is separated from the transfer belt 42 by a separation charger and a peel charger, and the separated recording sheet is sent to te fixing device 39. The fixing device 39 comprises a fixing roller 91 and a pressure roller 92 to fix the toner images to the recording sheet with heat and pressure. Thereafter, the recording sheet is discharged out of the apparatus.

According to this embodiment, the residual toner remaining on the transfer belt 42 is removed by the above-mentioned cleaning apparatus 41 after the electricity and the electrostatic absorbing force of the transfer belt are removed by a belt electricity removing device 46. That is to say, the transfer belt 42 is the member to be cleaned. In this case, a back-up brush 41*b* is disposed within the transer belt 42 in a confronting relation to the rotary brush 1.

On the other hand, the toner remaining on the photosensitive drums 31*a*, 31*b*, 31*c*, and 31*d* after the transferring operations is removed by a cleaners 36*a*, 36*b*, 36*c*, and 36*d*. In conclusion, foreign matters such as residual toner and paper powder remaining on the transfer belt 42 are removed by a toner cleaning apparatus 41 including the above-mentioned rotary brush 1.

In the above-mentioned embodiments, while an example that the present invention is mainly applied to the cleaning of the transfer drum was explained, the present invention may be applied to the cleaning of an image bearing member, for example. Such an image bearing member is not limited to the above-mentioned photosensitive drum. For example, a photosensitive body may be made of photo-conductive material, and the photo-conductive material may be amorphous silicone, amorphous selenium, zinc oxide, titanium oxide, organic photo-conductor (OPC) or the like. The photosensitive body may be coated on a rotatable member such as a drum, an endless belt and the like, or on a sheet. Incidentally, the drum and the belt are usually used, and, for example, the photosensitive drum is constituted by depositing or coating a photo-conductive layer on a cylinder made of aluminium alloy.

In the color laser beam printer shown in FIG. 6, a process cartridge 100 incorporating therein the photosensitive drum, cleaning means and charge means as a unit which can be removable be mounted to the printer is used.

According to the above-mentioned embodiments, the cleaning unevenness is eliminated by float-supporting the cleaning rotary member and following the cleaning rotary member to the tilt or inclination of the member to be cleaned, thereby ensuring the reliable cleaning.

Further, since the diameter of the cleaning rotary member is increased locally or gradually differentiated along its entire length, the rotation load of the cleaning rotary member can be reduced in total, thereby saving energy and making the apparatus compact.

Further, the filter can be prevented from being clogged locally. Additionally, since the brush is engaged by and disengaged from the member to be cleaned by sliding the brush case, the height of the cleaning apparatus can be reduced, thereby making the apparatus compact.

In addition, since the residual matter removed from the member to be cleaned can be collected in the brush case by utilizing the force generated by the rotation of the brush, any suction fan can be eliminated, thereby making the apparatus compact, saving energy and reducing discharge noise.

As mentioned above, according to the present invention, there is provided a cleaning apparatus and an electrophotographic image forming apparatus having such a cleaning apparatus, which can be made compact and improve the cleaning efficiency.

What is claimed is:

1. A cleaning apparatus which can be applied to an electrophotographic image forming apparatus and is adapted to remove toner adhered to a member to be cleaned, comprising:

a cleaning means including a brush member which can be rotated along its longitudinal direction for removing the toner adhered to said member to be cleaned;

a displaceable support means for supporting said cleaning means, including a casing for containing said cleaning means therein, being shiftable between an operative position where said cleaning means contacts with said member to be cleaned and a retract position where said cleaning means is retracted from said operative position; and an elastic means for elastically biasing said cleaning means supported by said support means toward said member to be cleaned.

2. A cleaning apparatus according to claim 1, further comprising a filter means for collecting the toner removed by said cleaning means, and a scattering means for scattering scatters the removed toner said filter means so as not to locally concentrate the removed toner on said filter means.

3. A cleaning apparatus according to claim 2, wherein said scattering means comprises a scattering member for scattering the removed toner entrained by an air flow generated by rotation of a brush member as said cleaning means toward left and right sides, and said scattering member is disposed in a confronting relation to a zone of a transfer drum as said member to be cleaned onto which a strip-shaped toner image formed on an elecrophotographic photosensitive member for image density adjustment is transferred.

4. A cleaning apparatus according to claim 1, wherein said member to be cleaned is a transfer drum, a toner adhered to a surface of a dielectric sheet provided on a peripheral surface of said transfer drum is removed by rotation of a brush member as said cleaning means and the removed toner is collected by a filter means, and said transfer drum holds a recording medium onto which a toner image formed on an electrophotographic photosensitive member of said image forming apparatus is transferred.

5. A cleaning apparatus which can be applied to an electrophotographic image forming apparatus and is adapted to remove toner adhered to a member to be cleaned, comprising:

a rotatable brush member for removing the toner adhered to said member to be cleaned;

a scattering means for scattering the removed toner entrained by an airflow generated by rotation of said brush member toward left and right sides in a longitudinal direction of said brush member; and a filter means disposed downstream of said scattering means in a flowing direction of the airflow to collect the toner removed by said brush member wherein the scattering means scatters the removed toner on said filter means so as not to locally concentrate the removed toner on said filter means.

6. A cleaning apparatus according to claim 5, wherein said scattering means is a scattering member for scattering the removed toner entrained by an airflow generated by the rotation of said brush member toward left and right in the longitudinal direction of said brush member, and said scattering member is disposed in a confronting relation to a zone of a transfer drum as said member to be cleaned onto which a strip-shaped toner image formed on an electrophotographic photosensitive member for image density adjustment is transferred.

7. A cleaning apparatus according to claim 5 or 6, wherein said member to be cleaned is a transfer drum, a toner adhered to a surface of a dielectric sheet provided on a peripheral surface of said transfer drum is removed by the rotation of said brush member and the removed toner is collected by said filter means, and said transfer drum holds a recording medium onto which a toner image formed on an electrophotographic photosensitive member of said image forming apparatus is transferred.

8. A cleaning apparatus which can be applied to an electrophotographic image forming apparatus and is adapted to remove toner adhered to a transfer drum which holds a recording medium onto which a toner image formed on an electrophotographic photosensitive member of said image forming apparatus is transferred, comprising:

a brush member rotatable in a longitudinal direction thereof for removing the toner adhered to said transfer drum;

a slidable slide means for supporting said brush member, including a casing for containing said brush member therein, so that said brush member can be shifted between an operative position where said brush member contacts with said transfer drum and a retract position where said brush member is retracted from said operative position;

an elastic means for elastically biasing said brush member supported by said slide means toward said transfer drum;

a scattering means for scattering the removed toner entrained by an airflow generated by rotation of said brush member toward left and right sides in a longitudinal direction of said brush member; and a filter means disposed downstream of said scattering means in a flowing direction of the airflow and adapted to collect the toner removed by said brush member, wherein the scattering means scatters the removed toner on said filter means so as not to locally concentrate the removed toner on said filter means.

9. A cleaning apparatus according to claim 8, wherein said scattering means is a scattering member for scattering the toner entrained by an airflow generated by the rotation of said brush member toward left and right sides in the longitudinal direction of said brush member, and said scattering member is disposed in a confronting relation to a zone of a transfer drum as said member to be cleaned onto which a strip shaped toner image formed on said electrophotographic photosensitive member for image density adjustment is transferred.

10. A cleaning apparatus according to claim 8, wherein said transfer drum includes a dielectric sheet provided on a peripheral surface of said transfer drum, and a toner adhered to a surface of said dielectric sheet is removed by the rotation of said brush member.

11. An electrophotographic image forming apparatus for forming an image on a recording medium, comprising:

(a) a cleaning apparatus including a brush member which can be rotated along its longitudinal direction for removing toner adhered to said member to be cleaned, a displaceable support means for supporting said cleaning means, including a casing for containing said brush member therein, so that said cleaning means can be shifted between an operative position where said cleaning means contacts with said member to be cleaned and a retract position where said cleaning means is retracted from said operative position, and an elastic means for elastically biasing said cleaning means supported by said support means toward said member to be cleaned; and (b) a convey means for conveying the recording medium.

12. An image forming apparatus according to claim 11, further comprising a filter means for collecting the adhered toner removed by said cleaning means, and a scattering means for scattering the toner not to concentrate the toner on said filter means locally.

13. An image forming apparatus according to claim 12, wherein said scattering means is a scattering member for scattering the removed toner entrained by an air flow generated by rotation of a brush member as said cleaning means toward left and right, and said scattering member is disposed in a confronting relation to a zone of a transfer drum as said member to be cleaned onto which a strip-shaped toner image formed on an electrophotographic photosensitive member for image density adjustment is transferred.

14. An image forming apparatus according to claim 11, wherein said member to be cleaned is a transfer drum, a toner adhered to a surface of a dielectric sheet provided on a peripheral surface of said transfer drum is removed by rotation of a brush member as said cleaning means and the removed toner is collected by a filter means, and said transfer drum holds a recording medium onto which a toner image formed on an electrophotographic photosensitive member of the image forming apparatus is transferred.

15. An image forming apparatus according to claim 11, wherein the image forming apparatus is a full-color laser beam printer.

16. An electrophotographic image forming apparatus for forming an image on a recording medium, comprising:

(a) a cleaning means including a rotatable brush member for removing toner adhered to a member to be cleaned, a scattering means for scattering the toner entrained by an airflow generated by rotation of said brush member toward left and right sides in a longitudinal direction of said brush member, and a filter means disposed downstream of said scattering means in a flowing direction of the airflow and adapted to collect the toner removed by said brush member, wherein the scattering means scatters the removed toner on said filter means so as not to locally concentrate the removed toner on said filter means; and (b) a convey means for conveying the recording medium.

17. An image forming apparatus according to claim 16, wherein said scattering means is a scattering member for scattering the toner entrained by an air flow generated by the rotation of said brush member toward left and right in the longitudinal direction of said brush member, and said scattering member is disposed in a confronting relation to a zone of a transfer drum as said member to be cleaned onto which a strip-shaped toner image formed on an electrophotographic photosensitive member for image density adjustment is transferred.

18. An image forming apparatus according to claim 16 or 17, wherein said member to be cleaned is a transfer drum, the toner adhered to a surface of a dielectric sheet provided on a peripheral surface of said transfer drum is removed by the rotation of said brush member and the removed toner is collected by said filter means, and said transfer drum holds a recording medium onto which a toner image formed on an electrophotographic photosensitive member of the image forming apparatus is transferred.

19. An image forming apparatus according to claim 16, wherein the image forming apparatus is a full-color laser beam printer.

20. An electrophotographic image forming apparatus for forming an image on a recording medium, comprising:

(a) a cleaning means including a rotatable brush member capable of being rotated in a longitudinal direction thereof for removing toner adhered to a transfer drum, a slidable slide means for supporting said brush member, including a casing for containing said brush member therein, so that said brush member can be shifted between an operative position where said brush member contacts with said transfer drum and a retract position where said brush member is retracted from said operative position, an elastic means for elastically biasing said brush member supported by said slide means toward said transfer drum, a scattering means for scattering the removed toner entrained by an airflow generated by rotation of said brush member toward left and right sides in a longitudinal direction of said brush member, and a filter means disposed downstream of said scattering means in a flowing direction of the airflow and adapted to collect the toner removed by said brush member, wherein the scattering means scatters the removed toner on said filter means so as not to locally concentrate the removed toner on said filter means; and (b) a convey means for conveying the recording medium.

21. An image forming apparatus according to claim 20, wherein said scattering means is a scattering member for scattering the toner entrained by an air flow generated by the rotation of said brush member toward left and right in the longitudinal direction of said brush member, and said scattering member is disposed in a confronting relation to a zone of a transfer drum as said member to be cleaned onto which a strip-shaped toner image formed on said electrophotographic photosensitive member for image density adjustment is transferred.

22. An image forming apparatus according to claim 20, wherein said transfer drum includes a dielectric sheet provided on a peripheral surface of said transfer drum, and the toner adhered to a surface of said dielectric sheet is removed by the rotation of said brush member.

* * * * *

UNITED STATES PATENT AND TRADEMARK OFFICE

CERTIFICATE OF CORRECTION

PATENT NO. : 5,612,775

DATED : March 18, 1997

INVENTOR(S) : TOMOO NAGAOKA

It is certified that error appears in the above-identified patent and that said Letters Patent is hereby corrected as shown below:

At [54] TITLE:

"DISPLACE" should read --DISPLACEABLE-- and "ELECTROPHTOGRAPHIC" should read --ELECTROPHOTOGRAPHIC--.

COLUMN 1:

Line 1, "DISPLACE" should read --DISPLACEABLE--.
Line 3, "ELECTROPHTOGRAPHIC" should read --ELECTROPHOTOGRAPHIC--.
Line 46, "matters" should read --matter--.

COLUMN 2:

Line 54, "synchronous" should read --synchronism--.

COLUMN 3:

Line 15, "38D" should read --38a--.
Line 25, "the" should be deleted.
Line 33, "means 30K," should read --means 30k,--

UNITED STATES PATENT AND TRADEMARK OFFICE

CERTIFICATE OF CORRECTION

PATENT NO. : 5,612,775

DATED : March 18, 1997

INVENTOR(S) : TOMOO NAGAOKA

It is certified that error appears in the above-identified patent and that said Letters Patent is hereby corrected as shown below:

COLUMN 6:

Line 9, "blade" should read --blades--.
Line 59, "air flow" should read --airflow--.

COLUMN 7:

Line 3, "air flow" should read --airflow--.

COLUMN 8:

Line 50, "slide" should read --slid--.
Line 65, "air flow" should read --airflow--.

COLUMN 9:

Line 3, "air flow" should read --airflow--.

COLUMN 10:

Line 47, "PC," should read --Pc,--.
Line 58, "31b," should read --31b, 31c,--.

UNITED STATES PATENT AND TRADEMARK OFFICE

CERTIFICATE OF CORRECTION

PATENT NO. : 5,612,775

DATED : March 18, 1997

INVENTOR(S) : TOMOO NAGAOKA

It is certified that error appears in the above-indentified patent and that said Letters Patent is hereby corrected as shown below:

COLUMN 11:

Line 14, "regist" should read --register--.
Line 21, "regist" should read --register--.
Line 37, "te" should read --the--.
Line 52, "a" should be deleted.

COLUMN 12:

Line 10, "the" (second occurrence) should be deleted.
Line 58, "toner" should read --toner on--.
Line 62, "air flow" should read --airflow--.

COLUMN 13:

Line 23, "member" should read --member,--.
Line 30, "right" should read --right sides--.

COLUMN 14:

Line 15, "strip shaped" should read --strip-shaped--.
Line 43, "not to" should read --so as not to locally--.
Line 44, "means locally." should read --means.--.

UNITED STATES PATENT AND TRADEMARK OFFICE

CERTIFICATE OF CORRECTION

PATENT NO. : 5,612,775

DATED : March 18, 1997

INVENTOR(S) : TOMOO NAGAOKA

It is certified that error appears in the above-indentified patent and that said Letters Patent is hereby corrected as shown below:

COLUMN 14: (continued)

Line 47, "air flow" should read --airflow--.
Line 49, "right," should read --right sides,--.

COLUMN 15:

Line 16, "air flow" should read --airflow--.
Line 17, "right" should read --right sides--.

COLUMN 16:

Line 25, "air flow" should read --airflow--.
Line 26, "right" should read --right sides--.

Signed and Sealed this

Sixteenth Day of December, 1997

Bruce Lehman

*Attest:*

BRUCE LEHMAN

*Attesting Officer*

*Commissioner of Patents and Trademarks*